US005381847A

United States Patent [19]

Ashok et al.

[11] Patent Number: 5,381,847

[45] Date of Patent: Jan. 17, 1995

[54] VERTICAL CASTING PROCESS

[75] Inventors: Sankaranarayanan Ashok, Bethany; Derek E. Tyler; William G. Watson, both of Cheshire; Harvey P. Cheskis, North Haven; George A. List, Milford, all of Conn.

[73] Assignee: Olin Corporation, New Haven, Conn.

[21] Appl. No.: 74,189

[22] Filed: Jun. 10, 1993

[51] Int. Cl.[6] ..... B22D 23/00

[52] U.S. Cl. ..... 164/46; 164/900

[58] Field of Search ..... 164/46, 271, 259, 475, 164/900

[56] References Cited

U.S. PATENT DOCUMENTS

| | | | |
|---|---|---|---|
| 3,695,341 | 10/1972 | Soeda et al. | 164/439 |
| 3,696,502 | 10/1972 | Darling . | |
| 3,826,301 | 7/1974 | Brooks . | |
| 4,485,834 | 12/1984 | Grant | 164/46 |
| 4,577,676 | 3/1986 | Watson . | |
| 4,779,802 | 10/1988 | Coombs . | |
| 4,961,457 | 10/1990 | Watson et al. . | |
| 4,971,133 | 11/1990 | Ashok et al. . | |
| 4,972,899 | 11/1990 | Tungatt . | |
| 4,977,950 | 12/1990 | Muench . | |
| 5,017,250 | 5/1991 | Ashok . | |
| 5,074,933 | 12/1991 | Ashok et al. . | |
| 5,131,451 | 7/1992 | Ashok et al. . | |

FOREIGN PATENT DOCUMENTS

| | | | |
|---|---|---|---|
| 60-36631 | 2/1985 | Japan | 164/46 |
| 1-313181 | 12/1989 | Japan | 164/46 |
| 2174411B | 11/1986 | United Kingdom . | |

OTHER PUBLICATIONS

J. Herbertson and R. I. L. Guthrie "A Novel Concept for Metal Delivery to Thin Strip Casters" Central Research Labs. Australia and McGill University, Canada The Metallurgical Society. (1988) appearing at pp. 335-348.

Shigeo Asai "Birth and Recent Activities of Electromahnetic Processing of Materials" ISU International (1989) No. 12. At pp. 981-992.

R. W. Evans: A. G. Leatham and R. G. Brooks "The Osprey Preform Process" reprinted from Powder Metallurgy. The Metals Society. 1 Carlton House Terrace London SW1Y 5DB, U.K.

M. C. Flemmings. "Behavior of Metal Alloys in the Semi-Solid State" Metall Trans., 22A. (1991) at p. 857.

*Primary Examiner*—Kuang Y. Lin

*Attorney, Agent, or Firm*—Gregory S. Rosenblatt

[57] ABSTRACT

There is provided an apparatus and method for the manufacture of metallic articles. A molten metal stream is disrupted, such as by gas atomization, to form a plurality of molten metal droplets. The molten metal droplets pass through a cooling zone having a length sufficient to allow up to about 30 volume percent of each of the droplets to solidify. A mold then receives and completes solidification of the metal droplets. When under about 30 volume percent of the droplets is solid, the droplets retain liquid characteristics and readily flow within the mold.

5 Claims, 4 Drawing Sheets

VERTICAL CASTING PROCESS

BACKGROUND OF THE INVENTION

This invention relates to an apparatus and method for casting metallic alloys. More particularly, the alloy is delivered to a mold as partially solidified droplets reducing the development of coarse dendrites.

In a conventional metal casting process, molten metal is delivered to a water cooled mold and solidifies by heat extraction through the surfaces of the mold. During solidification, dendritic growth occurs in certain alloy compositions. The dendrites grow from the mold walls and extend towards the center of the casting. Dendritic branching produces a three dimensional solid web. The dendritic web inhibits the flow of molten metal from the center of the mold to the solidification front. As a result, castings with significant porosity are produced. This type of directional dendritic solidification can also lead to hot tears.

One solution, disclosed in U.S. Pat. No. 4,577,676 to Watson, is reheating a portion of the mold subsequent to the formation of the dendrites. The dendrites detach from the mold and are remixed into the melt. The dendrites then serve as nuclei for grain refinement as the melt solidifies into a cast ingot.

Another method is disclosed in U.S. Pat. No. 4,972,899 to Tungatt. A feed tube separates a molten metal source from a mold. The feed tube is cooled by cyclically flowing cooling fluid. As the melt solidifies, a zone of fine dendrites is formed on the inner surface of the mold. An inductor reheats the zone of fine dendrites which then detach falling back into the melt. The dendrites serve as nuclei for grain refinement as the melt solidifies into a cast ingot.

One way to reduce dendritic growth is spray casting. Spray casting, as described in U.S. Pat. Nos. 3,826,301 and 3,909,921, both to Brooks and both incorporated in their entirety by reference herein, is the rapid solidification of metal into shaped preforms by means of an integrated gas atomizing/spray deposition process. A controlled stream of molten metal is delivered to a gas atomizer where high velocity jets of gas atomize the stream. The resulting spray of metal particles is directed onto a collector where the hot particles coalesce to form a dense preform. The preform can then be further processed, typically by hot working, to form a semi-finished or finished product.

Spray casting has been used to form alloys having a finer dispersion of intermetallics than is possible by conventional casting as disclosed in U.S. Pat. No. 5,074,933 to Ashok et al. Intermetallic growth is confined within the individual droplets of atomized metal, preventing the formation of a coarse intermetallic phase.

In conventional spray casting, the droplets are partially solidified or supercooled prior to impact with the collector. Solidification is rapidly completed following impact. The droplets are predominantly solid at the time of impact and the deposit has a high viscosity. As a result, gas pores are retained within the deposit. A second issue with conventional spray casting is overspray. About 20% of the droplets miss the collector and become powder scrap.

In conventional spray casting, predominantly solid droplets impact the collector. U.S. Pat. No. 5,131,451 to Ashok discloses formation of a metallic strip by spray casting onto a continuous belt. To ensure good metal flow across the belt, the droplets are at least 50% liquid. This method is particularly useful for casting metal strip. The method is limited to horizontal casting and the gas pressure and droplet velocity must be sufficiently low to minimize splashing. Turbulence generated by the atomized droplets striking the solidifying surface of the thin strip can cause shape control problems and macro-defects.

SUMMARY OF THE INVENTION

Accordingly, it is an object of the invention to provide an apparatus and method for the manufacture of a metallic article. It is a feature of the invention that dendritic growth is inhibited, reducing solidification shrinkage porosity of the casting and reducing hot tearing both during casting and during subsequent hot working. It is another feature of the invention that any shaped metallic article, including rods, billets and ingots, may be formed with reduced porosity. Yet another feature of the invention is that the cast structure has a uniform, nondendritic structure. This structure is a result of there being minimal distortion of the mold during casting, controlled transfer of heat during solidification and controlled nucleation.

It is an advantage of the invention that the articles have improved ductility and fracture toughness as compared to conventionally cast articles. While in conventional casting, 100% liquid metal is introduced into a mold, by the process of the invention, a part of the heat content of the melt is removed before introduction to the mold, improving mold life. Another advantage of the present invention is elimination of overspray. Metal recovery or yield is almost 100%. The droplets of the invention are larger than those of conventional spray casting. As a result, the surface area of the droplets is significantly less and reactive alloys such as aluminum and magnesium alloys may be cast more safety. The larger droplets also reduce the oxygen content. The gas consumption for atomization is reduced. Still another advantage is that heat is extracted through the mold walls rather than through a moving substrate. The mold walls may be designed to optimize the rate of heat exchange. For example, cooling means such as water coils may be embedded within the mold walls.

In accordance with the invention, there is provided an apparatus for the manufacture of a metallic article. The apparatus contains a molten metal source and a disruption site positioned to receive the molten metal. The disruption site converts the molten metal into a plurality of molten metal droplets. A cooling zone is disposed between the disruption site and a mold. The length of the cooling zone is that effective to allow a sufficient volume of an average droplet to solidify to inhibit the formation of coarse dendrites up to that volume fraction solid at which the viscosity rapidly increases. A mold then receives the partially solidified droplets and therein the solidification process is completed.

The above stated objects, features and advantages, will become more apparent from the specification and drawings which follow.

DETAILED DESCRIPTION

Figure 1:
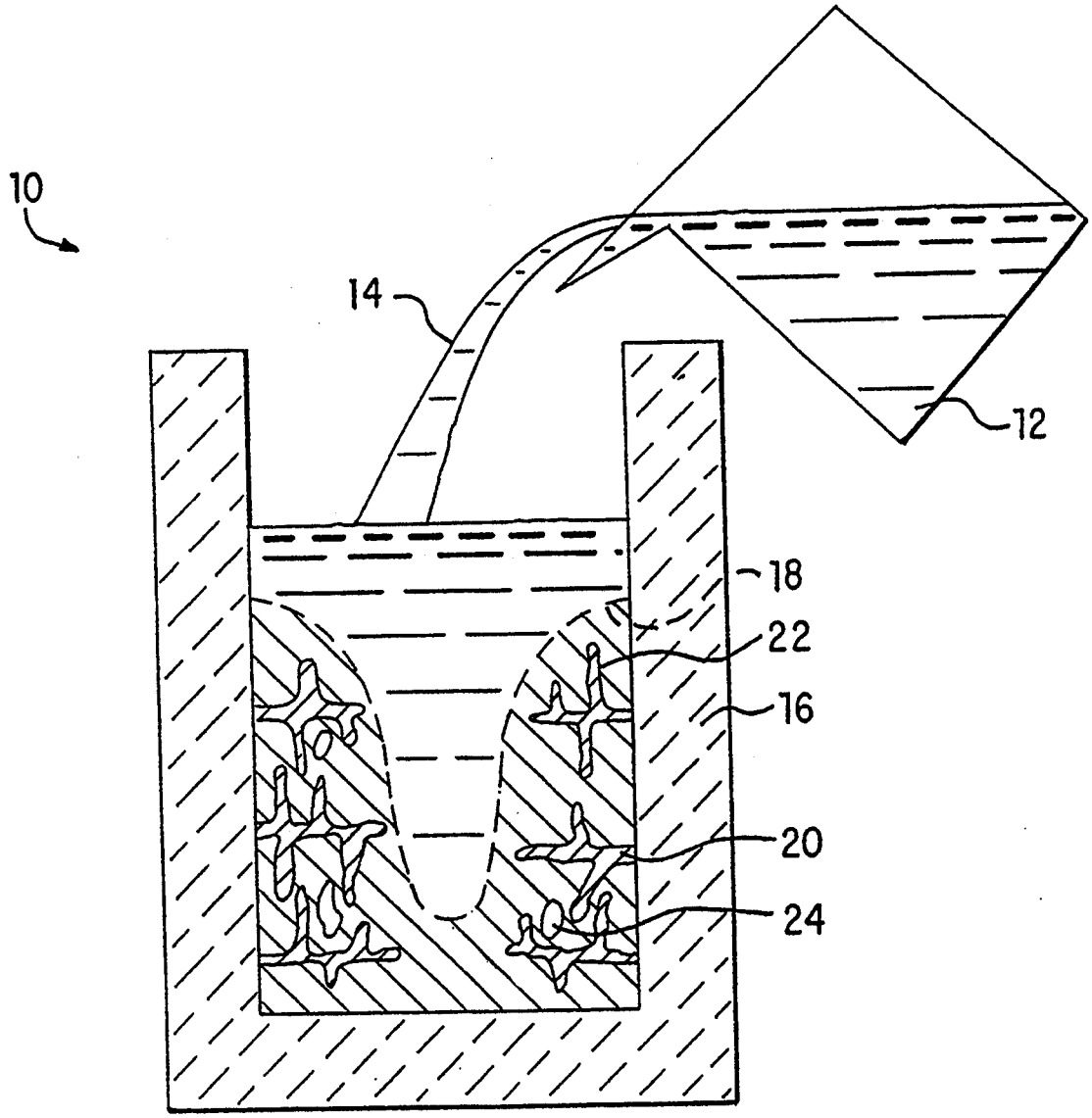
FIG. 1 shows in cross-sectional representation a book mold casting apparatus as known from the prior art.

FIG. 1 shows in cross-sectional representation a book mold casting apparatus 10 as known in the prior art. The casting apparatus 10 includes a molten metal source 12 such as a transfer lauder, conduit or other suitable means to deliver molten metal from a furnace. A stream of molten metal 14 is transferred to a suitable mold 16 typically machined from graphite, cast iron or water cooled copper. As the molten metal solidifies, a thermal gradient 18 moves upward through the casting. Because the predominant cooling mechanism is heat transfer through the walls of the mold 16, the thermal gradient is steep. Solidification shrinkage causes stresses to develop within the casting which can cause hot tearing. If the molten metal 14 composition is one which undergoes dendritic growth, dendrites 20 initially form along the walls of the mold 16. As solidification progresses, the dendrites develop branching arms 22 and coarsen. Over time, the dendrites 20 and branching arms 22 form a three dimensional solid web. The web prevents molten metal from the still liquid center of the casting from feeding the solidification front. As a result, pores 24 develop. The pores 24 reduce casting integrity and can cause hot tearing during subsequent hot working.

Figure 2:
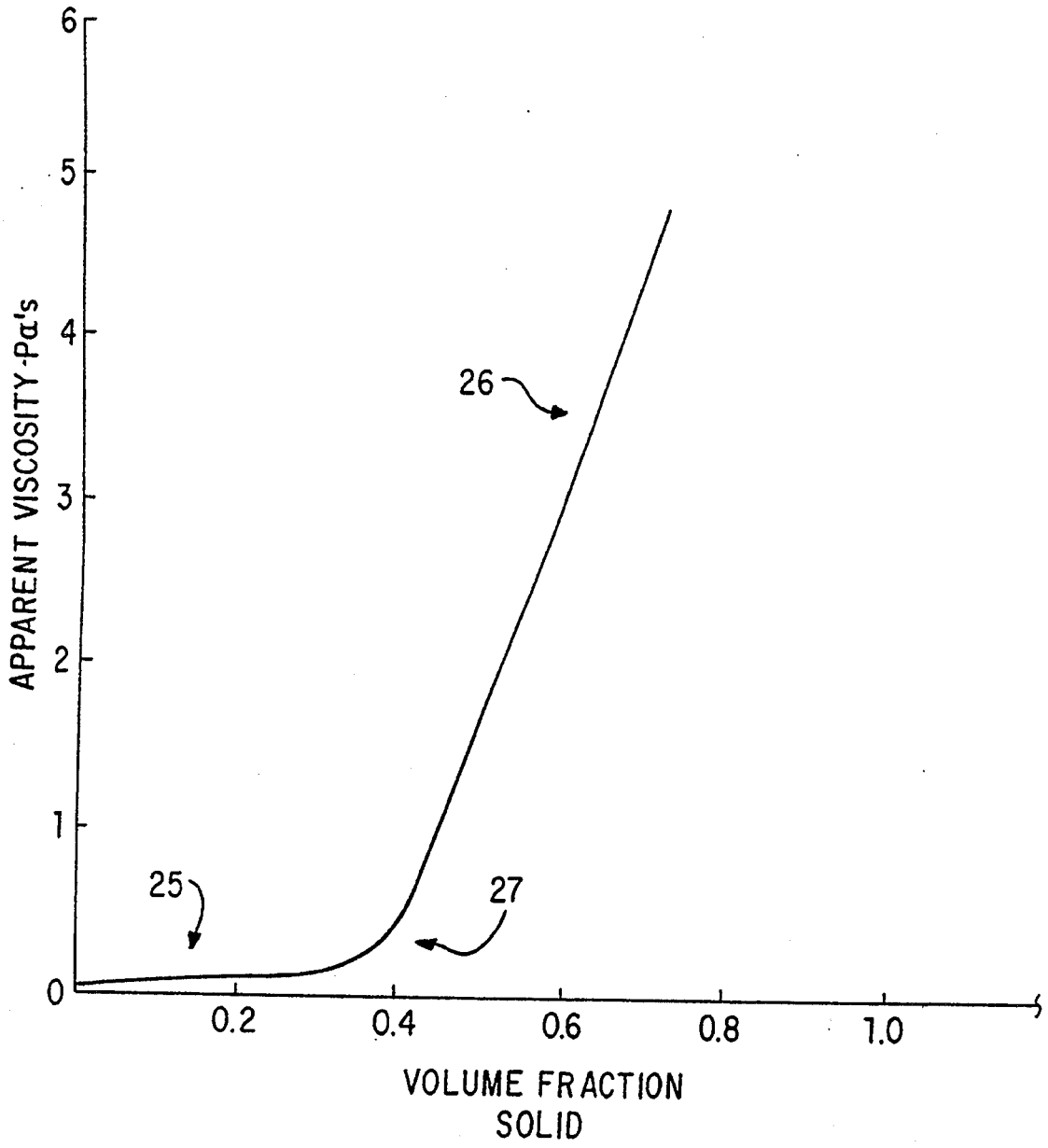
FIG. 2 shows in graphical representation the ratio between the apparent viscosity and the volume fraction solid as known from the prior art.

Dendritic growth can be inhibited and porosity reduced or eliminated by use of the apparatus and method of the invention. Prior to detailing the method and apparatus of the invention, the viscosity characteristics of semi-solid alloys must be reviewed. FIG. 2 shows in graphical representation, the relationship between apparent viscosity and the volume fraction solid for a semisolid alloy as known from the prior art. At a low volume fraction solid, as identified by region 25, the semi-solid alloy has low viscosity and flows like a liquid. At a high volume fraction solid, as identified by region 26, the semi-solid alloy has high viscosity and limited, at best, flow capability. There is an inflection point 27 at which the viscosity rapidly increases. While the precise location of the inflection point 27 is influenced by alloy composition and cooling rate, generally, the inflection point is in the range of about 30–40% by volume solid.

Figure 3:
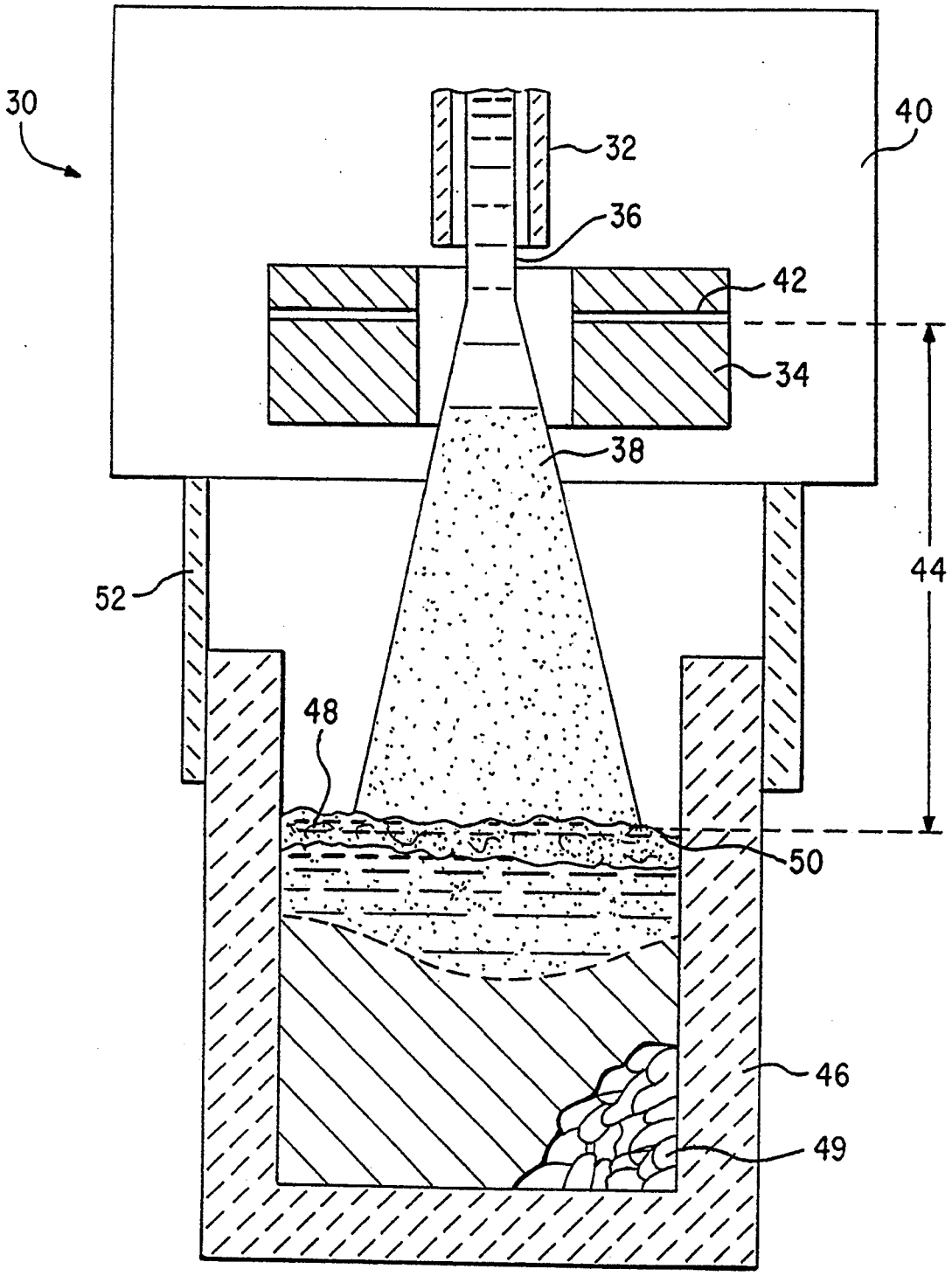
FIG. 3 shows in cross-sectional representation an apparatus for casting a metallic article in accordance with the invention.

FIG. 3 illustrates in cross-sectional representation a casting apparatus 30 in accordance with a first embodiment of the invention. The casting apparatus 30 includes a molten metal source 32 which may be a transfer lauder, conduit or other means known in the art. A disruption site 34 is positioned to receive a stream of molten metal 36 of a desired composition and converts that stream into a plurality of molten metal droplets 38. To prevent the droplets 38 from oxidizing, or with aluminum alloys or magnesium alloys, becoming a fire hazard, the molten metal source delivers the stream of molten metal to the disruption site in a controlled atmosphere 40. The controlled atmosphere 40 may be any gas or combination of gases which does not react with the molten metal stream 36. Generally, any noble gas or nitrogen is suitable. Other than alloys prone to excessive nitriding, nitrogen is preferred due to its low cost. When the molten metal stream 36 is a copper based alloy, preferred controlled atmospheres are nitrogen, argon and mixtures thereof. When the molten stream is a nickel based alloy or a steel, the preferred controlled atmospheres are nitrogen or argon.

The disruption site 34 comprises any suitable means for converting the molten metal stream 36 into a plurality of molten metal droplets 38. In gas atomization, as illustrated in FIG. 3, the disruption site 34 is a gas atomizer which circumscribes the molten metal stream 36 with one or more, and preferably, a plurality of jets 42. A high pressure atomizing gas, typically the same gas as the controlled atmosphere 40, impinges the molten metal stream 36 directed by jets 42 converting the molten metal stream into droplets 38 of controlled size and velocity.

Other types of molten metal stream disruption may be used to produce the spray of droplets, including magnetohydrodynamic atomization in which the stream of liquid metal is caused to flow through a narrow gap between two electrodes which are connected to a DC power supply with a magnet perpendicular to the electric field in the liquid metal. This type of atomization is more fully described in the publication entitled "Birth and Recent Activities in the Electromagnetic Processing of Materials"by Asai, ISIJ International, Volume 28, 1989, No. 12, at pages 981–992. Mechanical type atomizers as disclosed in U.S. Pat. No. 4,977,950 to Muench, may also be used.

The droplets 38 are broadcast downward from the disruption site 34 in the shape of a diverging cone. The droplets traverse a cooling zone 44 defined as the distance between the disruption site 34 and the upper surface 50 of the metal casting supported by the mold. The cooling zone 44 is of a length effective to insure that the volume fraction of an average droplet which is solid at the time of impact with the upper surface 50 of the metal casting is from that effective to inhibit coarse dendritic growth up to the volume fraction inflection point at which liquid flow characteristics is essentially lost. Generally, this upper solid volume fraction limit is about 40%. Preferably, from about 5% to about 40% by volume of the average droplet is solid. Most preferably, from about 15% to about 30% by volume percent of the average droplet solidifies in the cooling zone 44.

The partially molten metal droplets 38 are then collected in mold 46. When the amount of droplet solidification is less than the viscosity inflection point, about 40 volume percent, the semisolid droplets behave like a liquid, having sufficient fluidity to conform to the shape of the mold. The spray of droplets 38 creates a turbulent zone 48 at the surface of the casting. This turbulent zone has an approximate depth of from about 0.005 to about 1.0 inches dependent on the atomization gas velocity, the droplet velocity and the droplet size. For the method of the invention, the turbulent zone is believed to have a depth of about 0.25 to about 0.50 inches.

The turbulent zone should not exceed that region of the casting where the semi-solid alloy exhibits predominantly liquid characteristics. The lower viscosity of this region minimizes entrapment of gas. Preferably, the volume fraction of the average droplet which is solid while in the turbulent zone is less than about 50%. More preferably, within the turbulent zone 48, from about 5% to about 40% by volume of the average droplet is solid.

The mold 46 extracts heat both by conduction through the mold walls and by convection at the top surface 50 of the casting. The turbulent zone 48 at the top surface 50 is tolerable because the high mold walls reduce metal loss due to splashing. Also, the semisolid alloy in the turbulent zone has low viscosity so gas entrapped within the droplets will escape before the increasing viscosity during solidification traps the gas as pores in the casting. The turbulent zone reduces the thermal gradient of the casting, reducing hot tears and dendritic coarsening.

The mold may be formed from any suitable material such as graphite, cast iron and water cooled copper. Since the droplets are partially solidified prior to contacting the mold, less heat is removed than in conventional casting from a liquid, reducing thermally induced mold distortion. Reduced mold distortion leads to a more uniform rate of heat removal from the casting which improves the uniformity of the cast structure. Graphite is a preferred mold material since it is easy to machine and has good thermal conductivity. The removal of heat through the mold may be improved by cooling coils embedded in the graphite to circulate a fluid such as water, by the use of copper backing plate, or by other means known in the art.

The mold extracts heat from the casting, completing the solidification process. Sufficient nuclei are present as fine dendritic structures within each of the droplets so that on solidification, a fine equiaxed structure 49 is formed throughout the casting- The solidification front is easily fed and porosity and hot working cracking are substantially eliminated.

As the mold 46 is filled, the upper surface 50 of the casting moves closer to a disruption site 34, reducing the cooling zone 44. To maintain the same volume percent of solidification within the droplets, the disruption site or the mold, or both, may be mounted on a moveable support and separated at a fixed rate to maintain a constant cooling zone 44. Alternatively, the size of the molten metal droplets 38 is varied. An increased droplet size takes longer to solidify than relatively smaller droplets. When the disruption site 34 is a gas atomizer, the droplet size may be controlled by varying the velocity and volume of the gas impacting the metallic stream. Also, the temperature of the droplets may be varied by varying the temperature of the atomizing gas.

To prevent oxidation of the partially molten metal droplets 38, and to conserve the controlled atmosphere gas 40, it is preferred that baffles 52 extend between the controlled atmosphere of the molten metal droplet forming portion of the apparatus 30 and the mold 46.

The apparatus 30 of FIG. 3 is particularly suited for casting billets having diameters defined by the inside diameter of the mold 46. This inside diameter should be from about the width of the diverging cone of molten metal droplets 38 at the surface 50 of the casting to somewhat larger to exploit the fluidity of the partially solidified droplets. If the inside diameter of the mold is too large, the droplets excessively solidify before filling the mold and the benefits of the invention are lost. Accordingly, if large diameter bars are to be cast, a plurality of separate disruption sites 34 are provided. Each disruption site supplies a separate diverging cones of partially molten droplets 38 to the same mold.

Figure 4:
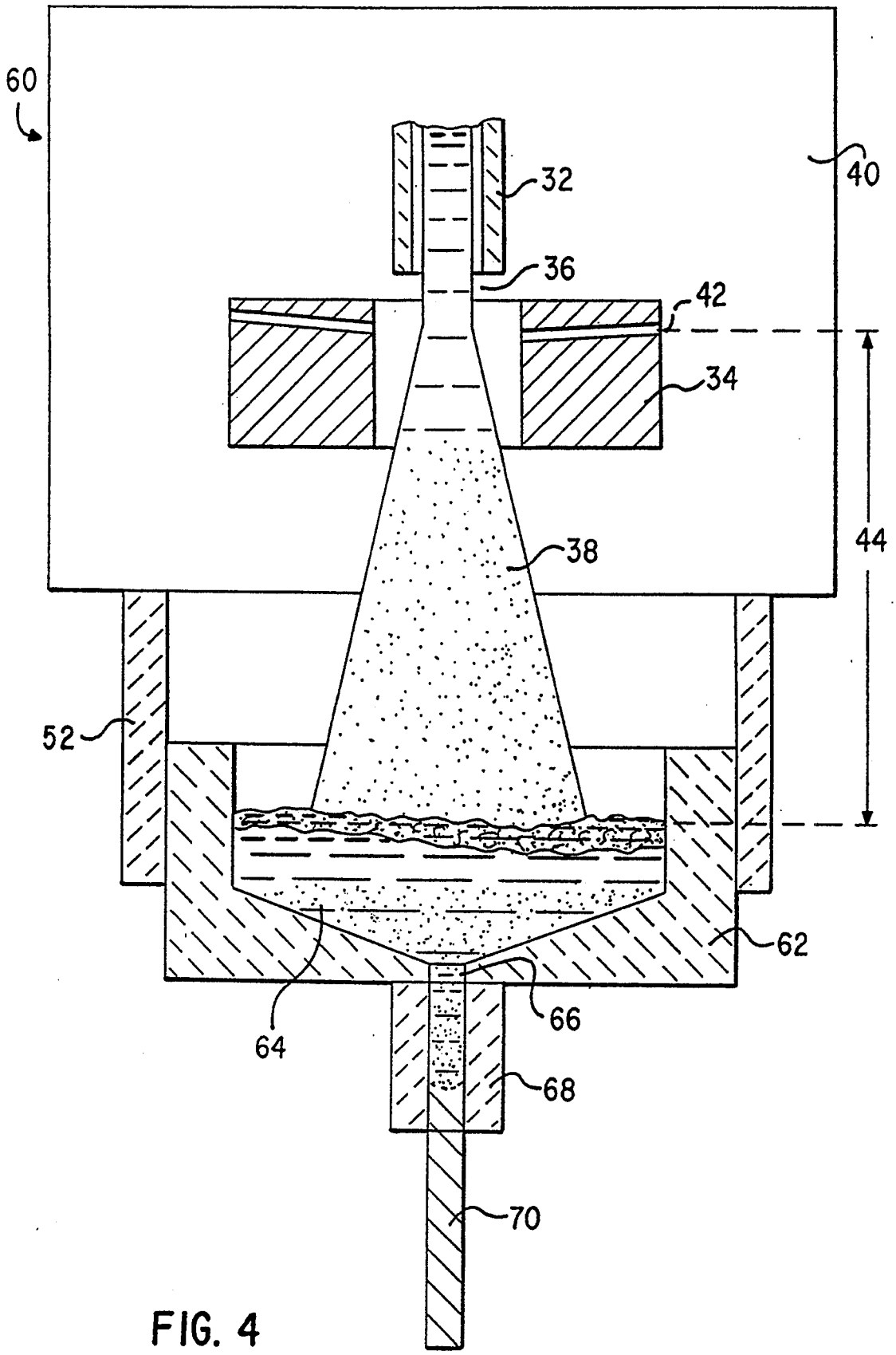
FIG. 4 shows in cross-sectional representation a second apparatus for casting of a metallic article in accordance with the invention.

If the structure to be cast has a cross-sectional area less than the diameter of the diverging cone, the apparatus 60 illustrated in cross-sectional representation in FIG. 4 is preferably utilized. The apparatus 60 is similar in many respects to the apparatus 30 of FIG. 3 and elements performing like functions are identified by like reference numerals. A molten metal source 32 provides a stream of molten metal 36 to a disruption site 34. The disruption site 34 converts the molten metal stream into a plurality of molten metal droplets 38. A cooling zone 44 disposed between the disruption site 34 and a hot top 62 has a length sufficient to allow from that volume fraction of the average droplet effective to inhibit coarse dendritic growth up to the viscosity inflection point to solidify.

The partially solidified droplets 64 are collected in a hot top 62. The hot top 62 is formed from a suitable thermally insulative material such as a refractory ceramic, such as $Al_2O_3$ or aluminosilicate. Minimal heat is lost through the walls of the hot top. The volume percent of the droplets which is solid remains below the viscosity inflection point so fluid characteristics are retained. The partially solidified melt 64 flows through an orifice 66 into a mold 68 defining the shape of the cast product 70. The mold 68 is formed of any material which does not react with the partially solidified melt 64, preferably graphite. Additional cooling means such as circulating water coils within the mold 68 or copper backing plates may be included to enhance solidification. The apparatus 60 is particularly suited for the continuous casting of rod and thin strip.

EXAMPLE

Computer simulation modeling was used to determine the droplet solidification behavior when the disruption site was gas atomization. Table 1 identifies the droplet size, cooling zone length, gas velocity and droplet velocity for copper alloy C655 (nominal composition by weight, 2.8–3.8% silicon, 0.5–1.3% manganese and the balance copper). It is desirable for the gas velocity to be less than the droplet velocity to prevent blowback of the molten metal. For copper alloys, a droplet size in excess of about 300 microns is desirable. The preferred droplet size for copper alloys is from about 400 to about 700 microns.

Spray casting copper alloy C655 having an average droplet size of 600 microns proved that liquid spray casting in a 5 inch diameter graphite mold was feasible. The resultant structure was equiaxed and nondendritic.

TABLE 1

| DROPLET SIZE (microns) | COOLING ZONE LENGTH 30% solidification (inches) | GAS-VELOCITY (meters per second) | DROPLET VELOCITY (Meters per second |
|---|---|---|---|
| 300 | 6 | 18 | 7 |
| 600 | 27 | 2 | 6.7 |
| 1000 | 64 | 0.05 | 6.7 |

While the invention has been primarily described in terms of copper based alloys, it is equally applicable to other alloy systems, including steel and nickel base, aluminum base, magnesium base, iron base, or titanium base alloys. It is applicable to the casting of bars, ingots, rods, strip, tube and any other desired shape.

The patents and publications set forth in this application are intended to be incorporated by reference.

It is apparent that there has been provided in accordance with this invention an apparatus and method for the manufacture of a metallic article having reduced porosity which fully satisfies the objects, means and advantages set forth hereinbefore. While the invention has been described in combination with specific embodiments and examples thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A method for casting a metallic article, comprising:
(a) disrupting a molten stream of metal into a plurality of molten metal droplets;
(b) partially solidifying said molten metal droplets such that from about 5% to about 40% by volume of each average droplet is solid and the remainder is molten; and
(c) collecting and completely solidifying said partially solidified droplets in a mold of a desired configuration thereby forming a metallic casting wherein a turbulent zone is generated by said droplets at the upper surface of said casting and, within said turbulent zone, on average, less than about 50% by volume of the average droplet is solid.

2. The method of claim 1 wherein in step (b), from about 15% to about 30% by volume of said average molten metal droplet is solid.

3. The method of claim 1 wherein in step (c), from about 5% to about 40% by volume of said average molten metal droplet is solid in said turbulent zone.

4. The method of claim 1 wherein said disrupting step is impingement of said molten stream of metal by one or more jets of an atomizing gas.

5. The method of claim 4 wherein the velocity of said atomizing gas is less than the velocity said partially molten metal droplets.

* * * * *